United States Patent [19]

Kawashima et al.

[11] 4,326,838

[45] Apr. 27, 1982

[54] SWASH PLATE TYPE COMPRESSOR FOR USE IN AIR-CONDITIONING SYSTEM FOR VEHICLES

[75] Inventors: Kenichi Kawashima; Kiyoshi Horibe, both of Hitachi; Takashi Degawa, Mito, all of Japan

[73] Assignee: Hitachi, Ltd., Tokyo, Japan

[21] Appl. No.: 46,042

[22] Filed: Jun. 6, 1979

[30] Foreign Application Priority Data

Jun. 7, 1978 [JP] Japan ..... 53-67704
Jul. 28, 1978 [JP] Japan ..... 53-91479

[51] Int. Cl.[3] ..... F04B 1/16
[52] U.S. Cl. ..... 417/269
[58] Field of Search ..... 417/269, 270, 439

[56] References Cited

U.S. PATENT DOCUMENTS

| | | | |
|---|---|---|---|
| 3,801,227 | 4/1974 | Nakayama | 417/269 |
| 3,888,604 | 6/1975 | Oshima | 417/269 |
| 3,904,320 | 9/1975 | Kishi | 417/269 |
| 3,930,758 | 1/1976 | Park | 417/269 |
| 3,955,899 | 5/1976 | Nakayama | 417/269 |
| 3,999,893 | 12/1976 | Kishi | 417/269 |
| 4,003,680 | 1/1977 | Nakayama | 417/439 |
| 4,127,363 | 11/1978 | Kato | 417/269 |
| 4,135,862 | 1/1979 | Degawa | 417/269 |

FOREIGN PATENT DOCUMENTS

| | | | |
|---|---|---|---|
| 2151128 | 5/1972 | Fed. Rep. of Germany | 417/269 |
| 50-36312 | 9/1975 | Japan | 417/269 |
| 50-145913 | 11/1975 | Japan | 417/269 |

*Primary Examiner*—William L. Freeh
*Attorney, Agent, or Firm*—Craig and Antonelli

[57] ABSTRACT

A swash plate type compressor for use in an air-conditioning system for vehicles. The compressor has a pair of cylindrical cylinder blocks which are disposed in axial alignment and contact with each other, cylinder bores formed in the cylinder blocks and pistons reciprocatably received by respective cylinder bores. A rotary shaft extends through the cylinder blocks coaxially with the latter, and carries a swash plate fixed thereto. The pistons are slidingly engageable with the swash plate such that they make reciprocating movement in respective cylinder bores as the swash plate is rotated. The swash plate is accommodated by a crank chamber defined in the pair of cylinder blocks. A lubrication oil is supplied to the sliding parts in the crank chamber. A pair of side plates are attached to respective ends of the cylinder blocks which are axially disposed and contacted by each other, through medium of valve plates. The side plates cooperate with corresponding valve plates in defining therebetween suction chambers. The suction chambers are in direct communication with the crank chamber so that the blow-by gas within the crank chamber is sucked into the suction chambers. An oil chamber is provided at the bottom portion of the cylinder blocks and communicated with the crank chamber.

4 Claims, 7 Drawing Figures

SWASH PLATE TYPE COMPRESSOR FOR USE IN AIR-CONDITIONING SYSTEM FOR VEHICLES

BACKGROUND OF THE INVENTION

1. Field of the Invention

The present invention relates to a swash plate type compressor for use in an air-conditioning system for vehicles and, more particularly, to a lubricating system for lubricating the sliding parts of this type of compressor.

2. Description of the Prior Art

In the conventional compressors of the kind described, the crank chamber accommodating an oscillatable or tiltable swash plate is separated from the refrigerant passage by means of a partition wall.

During the operation of the compressor, the pressure in the crank chamber is maintained at a level higher than the level of pressure in the refrigerant passage, because of the presence of the blow-by gas which has leaked through a small gap between the piston and the cylinder bore.

Therefore, if the design is such that the lubrication oil is supplied into the crank chamber through the refrigerant passage, the lubrication oil is inconveniently forced back by the high pressure in the crank chamber, resulting in an insufficient lubrication oil supply to the crank chamber.

In order to eliminate this drawback, U.S. Pat. No. 3,999,893 to Atsuo Kishi discloses a lubrication system in which whole part of the sucked gaseous refrigerant flows through the crank chamber on its way to the suction chamber of the compressor, so that the whole part of the lubrication oil carried by the sucked gaseous refrigerant may be introduced to the crank chamber without fail.

This solution, however, poses a new problem. Namely, the sucked gaseous refrigerant is heated and expanded as it flows through the crank chamber by the heat imparted by the blow-by gas and the heat generated due to the friction of the sliding parts in the crank chamber. The compression efficiency of the compressor is considerably lowered because the gaseous refrigerant is expanded before the latter is sucked into the suction chamber of the compressor.

Japanese Patent Laid-open Publication No. 145913/1975 to Shozoh Nakayama proposes a compressor which is freed from above stated problem. In this compressor, the crank chamber is materially separated from the refrigerant passage, and the small bores are formed in the partition wall of the crank chamber and the valve plate. The crank chamber is communicated with the suction chamber in the side cover through an oil chamber and a suction inner chamber in the side cover. This arrangement permits only a part of the sucked gaseous refrigerant to flow into the crank chamber so that the reduction of the compression efficiency as observed in the prior art of above-mentioned Kishi patent is avoided. In addition, since the crank chamber is communicated with the suction chamber, although this communication is made indirectly through the oil chamber, it is possible to reduce a little the pressure in the crank chamber during operation.

According to the disclosure in the Nakayama patent, however, the oil which is separated from the refrigerant and coming into the suction inner chamber is conveyed by the blow-by gas to the suction chamber of the compressor. Since the blow-by gas is made to flow into the suction inner chamber which is disposed in the suction chamber and opposed by an extremely restricted central area of the valve plate, it is not allowed to adopt a sufficiently large diameter of the small bore formed in the valve plate. For the same reason, the shape of the small bore is inevitably rendered complicated to increase the flow resistance.

Consequently, it is not possible to obtain a flow rate of the blow-by gas which is enough to cause a sufficient reduction of pressure in the crank chamber, resulting in an insufficient supply of the oil from the oil supplying means.

In addition, since only a small part of the sucked gaseous refrigerant is allowed to flow into the crank chamber, it is not possible to obtain a sufficient cooling effect in the crank chamber nor to effect a sufficient lubrication in the crank chamber by the lubricant carried by the refrigerant.

SUMMARY OF THE INVENTION

It is, therefore, a major object of the invention to provide a swash plate type compressor for use in an air-conditioner for vehicles, in which the lubrication system is improved to assure a better condition of lubrication.

It is another object of the invention to provide a swash plate type compressor for use in an air-conditioner for vehicles, in which the pressure in the crank chamber is sufficiently lowered to promote the lubrication oil supply to the sliding parts in the crank chamber and to permit the introduction of the gaseous refrigerant into the crank chamber at an adequate rate.

It is still another object of the invention to provide a swash plate type compressor for use in an air-conditioner for vehicles, which is designed and constructed to assure the lubrication oil supply to the sliding parts in the crank chamber at the time of starting of the compressor.

To this end, according to one aspect of the invention, there is provided a swash plate type compressor comprising a crank chamber defined by a partition wall surrounding an oscillatable swash plate, and means for supplying a lubrication oil to the sliding parts in the crank chamber. The crank chamber is in direct communication with a suction chamber in a side cover of the compressor, so that the blow-by gas staying in the crank chamber is positively or forcibly induced into the suction chamber.

The invention provides, in its another aspect, a swash plate type compressor comprising a crank chamber defined by a partition wall surrounding an oscillatable swash plate, a lubrication oil tank disposed in the compressor, and conduit means for providing communications between the lubrication oil tank and the crank chamber, and between the crank chamber and a suction chamber disposed in a side cover of the compressor, whereby, when a boiling or priming of the lubrication oil has taken place due to a foaming at the time of starting, the oil is made to flow into the crank chamber without fail.

The above and other objects, as well as advantageous features of the invention will become more clear from the following description of the preferred embodiments taken in conjunction with the accompanying drawings.

DESCRIPTION OF THE PREFERRED EMBODIMENTS

Preferred embodiments of the invention will be fully described hereinunder with reference to the accompanying drawings.

Figure 1:
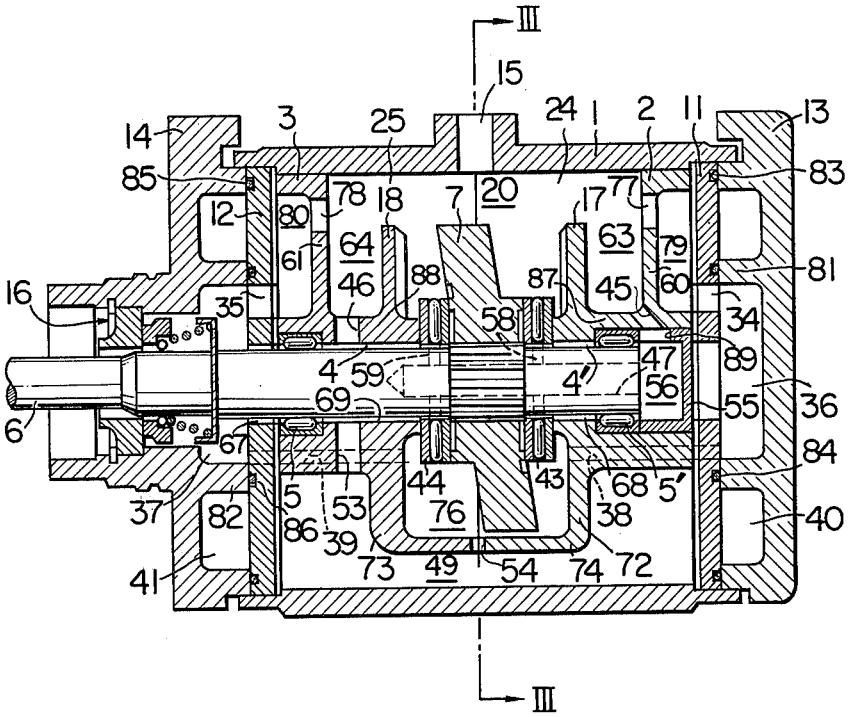
FIG. 1 is a longitudinal sectional view of a swash plate type compressor which is a first embodiment of the invention, taken along the line I-O-I of FIG. 3.
Figure 2:
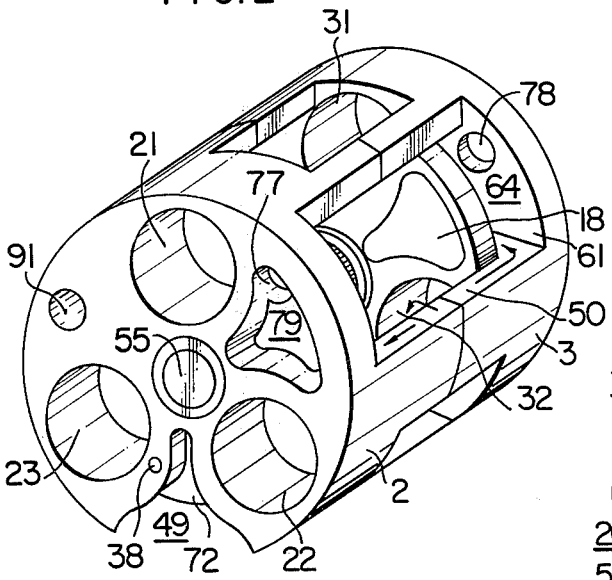
FIG. 2 is a perspective view of cylinder blocks in the assembled state incorporated in the compressor as shown in FIG. 1.

Referring first to FIG. 1, a swash plate type compressor constructed in accordance with a first embodiment of the invention has a cylindrical outer shell 1 and a pair of substantially symmetrical cylinder blocks 2, 3 made of aluminum and fittingly received by the outer shell 1. These cylinder blocks 2, 3 are coupled to each other in a manner shown in FIG. 2.

Bores 4, 4' for receiving a common rotary shaft 6 are formed coaxially through the cylinder blocks 2, 3. The bores 4, 4' carry roller bearings 5, 5' for rotatably supporting the rotary shaft 6. The cylinder block 2 is provided with three cylinder bores 21, 22, 23 which are disposed at an equal radial distance from the central axis of the cylinder block 2 and are equispaced in the circumferential direction. The cylinder block 3 has similar cylinder bores 31, 32 and 33 which are coaxial, respectively, with the cylinder bores 21, 22 and 23 of the cylinder block 2.

Figure 4:
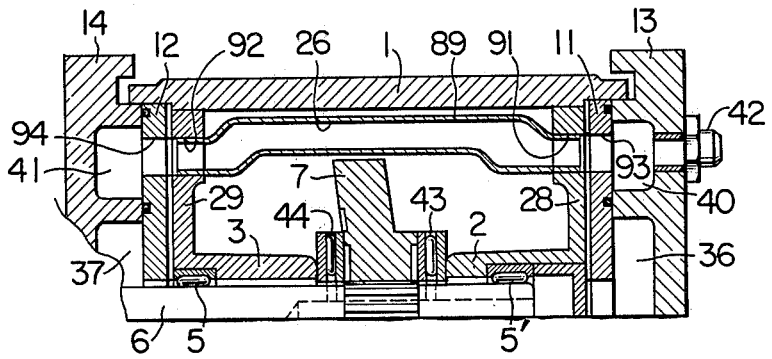
FIG. 4 is a sectional view taken along the line O-IV of FIG. 3.

Each cylinder block 2, 3 has three sector spaces defined between each adjacent cylinder bores. As will be seen from FIG. 1, one of these three spaces constitutes a lubrication oil chamber 49. One of the remainder two sector spaces constitutes a refrigerant suction passage 20 and 24, 25 for the sucked gaseous refrigerant, while the other constitutes, as shown in FIG. 4, a refrigerant discharge passage 26.

The compressor is installed such that the oil tank or chamber 49 takes the lowermost position in the vertical direction.

The rotor shaft 6 is rotatably supported by the roller bearings 5, 5' so as to extend coaxially with the cylinder blocks 2, 3. A swash plate 7 fixed to the rotary shaft 6 is positioned at the central portion of the cylinder blocks 2, 3, as viewed in the axial direction.

Figure 3:
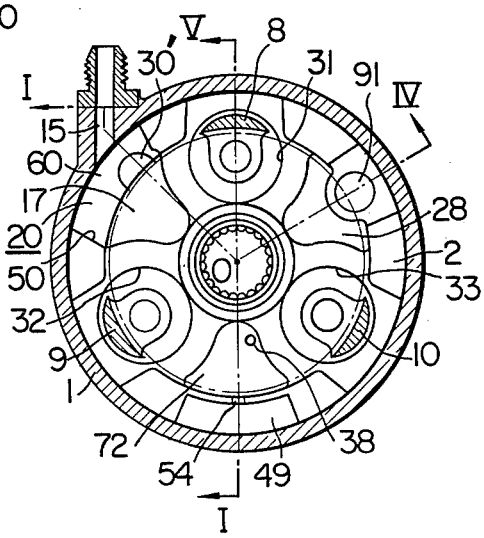
FIG. 3 is a sectional view taken along the line III—III of FIG. 1.
Figure 5:
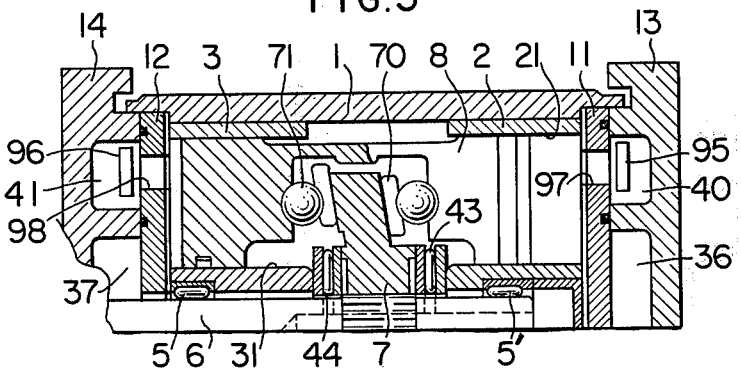
FIG. 5 is a sectional view taken along the line O-V of FIG. 3.

As will be seen from FIGS. 3 and 5, double-headed pistons 8, 9, 10 straddling the swash plate 7 are engaged by the latter through medium of shoes 70 and balls 71. The pistons 8, 9 and 10 are slidably received by the cylinder bores 21, 31; 22, 32 and 23, 33, respectively.

Valve plates 11, 12 are held in contact with the outer ends of the cylinder blocks 2. 3. More specifically, these valve plates 11, 12 are clamped and pressed against the end surfaces of the cylinder blocks 2, 3 by means of side covers 13, 14 which are fixed to both opened ends of the outer shell 1. At the center of the shell 1 is disposed a refrigerant suction port 15.

One of the ends of the rotary shaft 6 extends through the center of the side cover 14 to the outside of the latter. A shaft seal device 16 is interposed between the rotor shaft 6 and the side cover 14.

A crank chamber 76 is formed at the center of the cylinder blocks 2, 3, by partition walls 17, 18 in the refrigerant suction passages 20, 24, 25, partition walls 72, 73, 74, 75 in the oil chamber 49 and partition walls 28, 29 in the discharge passage 26. Thus, the crank chamber 76 in which the swash plate oscillates is materially isolated from the oil chamber 49 and the refrigerant suction passages 20; 24, 25.

The refrigerant suction passages 20; 24, 25 further include second partition walls 60, 61 which are disposed between the valve plates 11, 12 and the first partition walls 17, 18 so as to cooperate with the latter in defining therebetween oil separating chambers 63, 64. Passage bores 77, 78 are formed at radially outer parts of the partition walls 60, 61, while passage bores 34, 35 are formed at radially inner parts of the valve plates 11, 12. Between the partition walls 60, 61 and the valve plates 11, 12, are defined spaces 79, 80 through which the through bores 77 and 34, and the through bores 78 and 35 are communicated with each other.

The side covers 13, 14 are provided with annular protrusions or partition walls 81, 82 concentric with the rotary shaft 6. These partition walls 81, 82 define at their radially inner and outer sides suction chambers 36, 37 and discharge chambers 40, 41. Between the valve plates 11, 12 and the side covers 13, 14, are sandwiched annular seal rings 83, 84 and 85, 86 by means of which the suction and discharge chambers are prevented from communicating with each other and with ambient air.

The passage bores 34, 35 in the valve plates 11, 12 are communicated with the suction chambers 36, 37, respectively.

The bottom portions of the suction chambers 36, 37 are in communication with the crank chamber 76, through the valve plates 11, 12, by means of passage bores 38, 39 which are formed axially through hubs 87, 88 of the cylinder blocks 2, 3. In addition, the crank chamber 76 is in communication with the oil chamber 49 through a passage bore 54 formed in the bottom partition walls 72, 73.

Further, the oil chamber 49 is made to communicate with the bottom portion of the oil separation chamber 64, through radial passage bores 46, 53 formed in the hub 87 of the cylinder block 3.

On the other hand, a blind cap 55 is disposed between the valve plate 11 and the associated end of the rotary shaft 6, such that the cap 55 defines an oil collecting chamber 56 in cooperation with the end of the shaft 6. The oil collecting chamber 56 is communicated with the oil separation chamber 63 through a radial passage bore 45 formed in the hub 87 of the cylinder block 2 and through a notch 89 formed in the cap 55.

Thrust bearings 43, 44 are adapted to receive and bear the thrust load which acts between the cylinder block and the swash plate 7.

At the center of the rotary shaft 6, is formed an oil feeding bore 47 which extends axially from the end of the shaft 6 confronting the oil collecting chamber 56 toward the other end of the shaft 6. Small bores 58, 59 are formed in the rotary shaft 6 to extend radially from the oil feeding bore 47. In operation, the lubrication oil is forcibly supplied to the thrust bearings 43, 44 through the oil feeding bore 47 and the radial small bores 58, 59 by the action of the centrifugal force.

The small space or gap 68, formed between the rotary shaft 6 and the hub 87 of the cylinder block 2, permits the communication of the thrust bearing 43 with the roller bearing 5' which, in turn, is in communication with the oil collecting chamber 56. Meanwhile, the small space or gap 69 preserved between the rotary shaft 6 and the hub 88 of the cylinder block 3 provides the communication of the roller bearing 5, passage bores 46, 53 and the thrust bearing 44 with one another.

The small space or gap 67 formed between the valve plate 12 and the rotary shaft permits the roller bearing 5 to be communicated with the suction chamber 37.

As shown in FIG. 4, the left and right discharge chambers 40, 41 are communicated with each other through a copper pipe 89 constituting the refrigerant discharge passage 26. The pipe 89 is fitted at its one end to a bore 91 formed in the partition wall 28, while the other end is fittingly received by a bore 92 formed in the partition wall 29, so that the pipe 89 is in communication with the discharge chambers 40, 41 through the passage bores 93, 94.

The refrigerant discharged from the left and right discharge chambers are delivered to the refrigeration cycle through a discharge port 42 attached to the side cover 13.

In FIG. 5, reference numerals 95, 96 denote discharge valve supports attached to the side of the valve plates 11, 12 facing respective discharge chambers 40, 41, while numerals 97, 98 denote discharge ports provided in the valve plates 11, 12.

The swash plate type compressor of the first embodiment having the above described construction operates in the manner described hereinunder.

During the normal running of the compressor, the flow of refrigerant of low pressure and temperature, coming through the suction port 15 is divided in the refrigerant suction passage 20 into two flow components which flow into respective suction chambers 36, 37 through the suction passages 24, 25, passage bores 77, 78, spaces 79, 80 and then through the passage bores 34, 35.

The sucking force generated in the suction chambers 36, 37 exhibits six peaks while the swash plate 7 makes one revolution.

When the sucking force in the suction chambers 36, 37 takes the peak value, the blow-by gas in the crank chamber 76 is positively sucked into the suction chambers 36, 37 through the passages 38, 39 so that the pressure in the crank chamber 76 is decreased. In the period between adjacent peaks of the sucking force, the blow-by gas can naturally flow into the suction chambers 36, 37 due to the pressure possessed by the gas itself.

Therefore, the pressure in the crank chamber 76 is maintained at a level near the level of pressure of the sucked refrigerant, so that a part of the sucked refrigerant is introduced into the crank chamber 76 from the suction passage 20. In consequence, the lubrication oil mixed in the refrigerant is directly supplied onto the swash plate 7 to lubricate the latter.

A part of the lubrication oil in the sucked refrigerant flows straight through the suction port 15 and collides with the notched surface 50 (See FIGS. 2 and 3) formed in the peripheral wall of the cylinder block. Further, a part of the oil which has collided with the notched surface flows into the crank chamber 76 as shown by an arrow in FIG. 2, while the remainder flows along the notched surface 50 into the oil separation chambers 63, 64.

A part of the oil floating in the crank chamber 76 and a part of the oil suspended by the sucked refrigerant are made to flow into the oil separation chambers 63, 64 through the passages 24, 25 and are accumulated on the bottom of the oil separation chambers 63, 64 immediately before they pass the passage bores 77, 78 or upon collision with the partition walls 60, 61.

Then, the sucked refrigerant from which the most part of the oil suspended thereby has been removed flows, together with the blow-by gas, into the suction chambers 36, 37 through the aforementioned passages. The refrigerant is then sucked into the cylinder bores by the pumping actions of the pistons 8, 9, 10 which reciprocatingly slide within the cylinder bore as an oscillatory rotation of the swash plate 7, and compressed in the cylinder bores and discharged into the discharge chambers 40, 41.

The refrigerant discharged into the discharge chamber 41 is then collected into the discharge chamber 40 through the discharge passage 26. The collected refrigerant is then forwarded from the chamber 40 to the refrigeration cycle through the discharge port 42.

The refrigerant flowing into the suction chambers 36, 37 through the refrigerant suction passages 20, 24, 25 contains only a little amount of oil, because this refrigerant has been rid of the oil on its way to the suction chambers, whereas the blow-by gas is rich in the lubrication oil. This oil is circulated through the refrigeration cycle together with the refrigerant, and is returned to the suction port 15.

Meanwhile, the lubrication oil accumulated in the oil separation chamber 63 flows to the oil collecting chamber 56 through the passage bore 45, and then flows into the thrust bearings 43, 44 through the oil feeding bore 47 and then through the small bores 58, 59 formed in the rotary shaft 7.

In this state, since a sufficiently low pressure is maintained in the crank chamber 76, no pressure acts on the small bores 58, 59 so that the lubrication oil is allowed to smoothly flow into the crank chamber 76 through the thrust bearings 43, 44.

Needless to say, it is possible to effect a more forcible lubrication of the thrust bearings, by imparting a positive pressure to the oil by means of, for example, a gear pump or the like.

The oil accumulated in the oil separation chamber 64 flows through the passage bores 46, 53 and a part of which is made to flow down into the oil chamber 49.

As the compressor operates over a longer period of time, the amount of oil accumulated in the oil chamber 49 is gradually increased. When the level of oil accumulated in the oil chamber 49 is higher than the lower surface of the crank chamber 76, the oil flows into the crank chamber 76 because the pressure in the latter is comparatively low. The oil is then stirred by the swash plate 7 and mixed with the blow-by gas and is returned to the suction port 15 through the aforementioned recirculation passage.

A part of the oil flowing into the passage bore 46 flows also into the suction chamber 37 through the roller bearing 5 and then through the small space 67.

The small spaces 68, 69 are always filled with the lubrication oil, and a flow of oil is formed from either one to the other of the roller bearing and the thrust bearing, depending on the levels of pressures in these bearings.

As the compressor is stopped, the lubrication oil in the compressor flows downward along the wall of the cylinder block. Although most part of this oil stays in the oil chamber 49, the remainder of the oil is made to stay in the oil collecting chamber 56 and small spaces 68, 69. Further, a small amount of oil stays in the roller bearings 5, 5', thrust bearings 43, 44 and also in the small gap between the shoes 70 and the swash plate 7.

The oil in the crank chamber 76 is accumulated on the bottom of the crank chamber 76. However, when the oil level in the oil chamber 49 is lower than the level of the bottom of the crank chamber, the oil in the chamber 76 is allowed to flow down into the oil chamber 49 through the passage bore 54.

The oil in the suction chambers 36, 37 flows into the crank chamber 76 through the passage bores 38, 39, while the oil in the oil separation chamber 64 flows down to the oil chamber 49 in the same manner as described before through the passage bores 46, 53.

Upon the start in operation of the compressor, the pressures in the spaces other than the oil chamber 49 drastically lowered due to the sucking action in the suction chambers 36, 37.

In consequence, a phenomenon called foaming or boiling of the refrigerant contained by the oil takes place in the oil chamber 49. Since the crank chamber 76 is communicated with the suction chambers 36, 37 through short passages 38, 39, the pressure in the crank chamber 76 is decreased to a level which is sufficiently low as compared with the pressure in the oil chamber 49. In addition, the crank chamber 76 is communicated with the passage bore 54 which is extremely short. For these reasons, as the foaming takes place in the oil chamber 49 as stated above, the crank chamber 76 receives the flooding oil flow from the oil chamber 49 earlier than any other portion of the compressor. This flow of oil into the crank chamber 76 assumes a form of a spray or a jet of oil which is directed from the passage 54 directly to the swash plate 7. Consequently, the lubrication oil is supplied to the surface of the swash plate 7, almost simultaneously with the starting of the compressor. This conveniently eliminates the seizure of the swash plate 7, which is liable to be caused when the compressor is started in such a condition that the surface of the swash plate 7 has been dried due to a long suspension of operation of the compressor as in the winter season.

Figure 6:
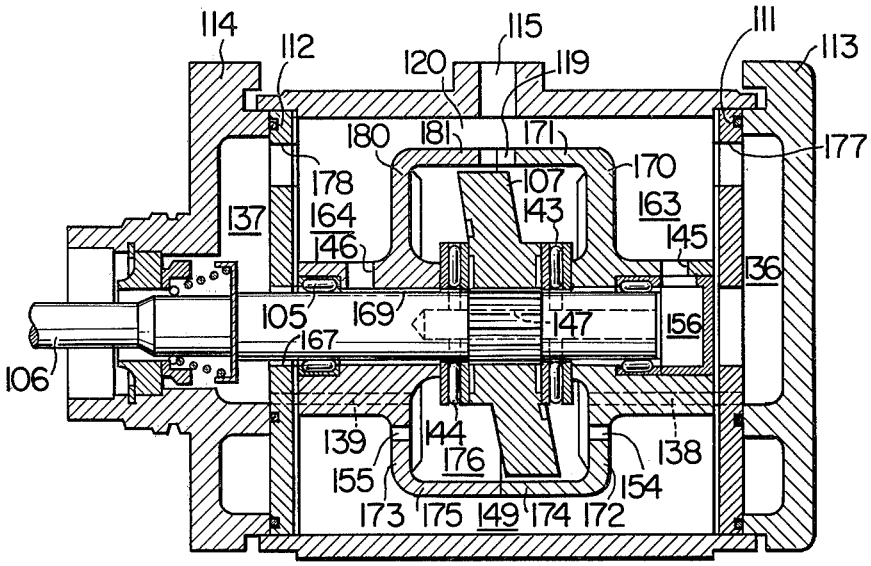
FIG. 6 is a sectional view similar to that of FIG. 1 of a second embodiment of the invention.

FIG. 6 shows a second embodiment of the invention. In this second embodiment, the space in which a swash plate 107 oscillates is separated from the refrigerant suction passage 120 by means of side walls 170, 180 and the peripheral walls 171, 181. At the juncture of the peripheral walls 171, 181, is formed a passage bore 119 which extends on the extension of the axis line of a suction port 115.

The partition wall 170 and a valve plate 111 cooperate with each other in defining an oil separation chamber 163 in the refrigerant suction passage. Similarly, the partition wall 180 and a valve plate 112 cooperate with each other to define an oil separation chamber 164.

Passage bores 177, 178 are formed at radially outer part of the valve plates 111, 112, through which the refrigerant suction passage 120 is communicated with the suction chambers 136, 137.

This second embodiment is similar to the first embdoiment in that the space in which the swash plate 107 oscillates is separated from the oil chamber 149 by the side walls 172, 173 and the peripheral walls 174, 175. However, in this second embodiment, through bores 154, 155 interconnecting the oil chamber 149 and the crank chamber 176 are formed at the sides of the side walls 172, 173 closer to the rotary shaft 106. In addition, suction chambers 136, 137 formed within the side covers 113, 114 coaxially with the rotary shaft have a cross-section perpendicular to the axis substantially circular but expanded radially outwardly at their portions confronting the passage bores 177, 178 of the valve plates 111, 112.

The refrigerant flowing from the suction port 115 collides with the notch 50 in the peripheral wall of the cylinder block as it flows through the refrigerant passage 120, as the first embodiment shown in FIG. 3, so that a part of the oil contained by the refrigerant is separated from the latter. At the same time, a part of the oil is separated from the refrigerant as the latter collides with the peripheral walls 171, 181 of the crank chamber. However, in contrast to the case of the first embodiment, this separated oil does not flow into the crank chamber 176 but is made to flow into the left and right oil separation chambers 163, 164.

Meanwhile, the right and left flow components of the refrigerant, which have shunted from each other in the passage 120 for the sucked refrigerant, flow also into the oil separation chambers 163, 164. The flow velocity of the refrigerant is drastically lowered as the latter flows into the oil separation chambers 163, 164, because these oil separation chambers 163, 164 have considerably large volumes. Consequently, the oil contained by the refrigerant is naturally made to drop onto the bottom of each oil separation chamber 163, 164, by the force of the gravity, because it has a large specific weight as compared with the gaseous refrigerant. Therefore, only the refrigerant is allowed to be sucked into the suction chambers 136, 137 through the passage bores 177, 178.

The oil accumulated on the bottom of the oil separation chamber 163 flows through a passage bore 145 into an oil collecting chamber 156 which is provided, as is the case of the first embodiment, at the end of the rotary shaft 107, and is then supplied to the thrust bearings 143, 144 through an oil feeding bore 147 formed in the rotary shaft.

As in the case of the first embodiment, the crank chamber 176 is in direct communication with the suction chambers 136, 137 through the passage bores 138, 139, so that a positive flow of the blow-by gas into the suction chambers takes place, partly because of the pressure possessed by the blow-by gas itself and partly because of the sucking action of the compressor, to lower the pressure in the crank chamber to a level lower than the pressure in the refrigerant passage 120.

Consequently, the flow of the oil supplied from the oil collecting chamber 156 is rendered smooth to ensure the lubrication oil supply to the thrust bearings 143, 144 and also to the surface of the swash plate 107.

Further, a part of the refrigerant of low temperature is induced into the crank chamber from the refrigerant passage 120 through the passage bore 119 to adequately cool the sliding parts to provide a good lubrication effect.

On the other hand, the oil accumulated in the oil separation chamber 164 flows into the space 169 around the rotary shaft 106 through the passage bore 146. A part of this oil is introduced into the suction chamber 137 through the roller bearing 105 and the small space 167, while the remainder flows into the crank chamber 176 through the thrust bearing 144.

In this second embodiment, it is possible to increase the amount of oil staying in the oil separation chamber, because the oil separated from the refrigerant when the latter collides with the notch 50 (See FIG. 3) in the peripheral wall of the cylinder block and the peripheral walls 171, 181 of the crank chamber 176 does not flow into the crank chamber 176 but is introduced into the oil separation chambers 163, 164.

The oil which has lubricated the thrust bearings is atomized by the stirring action caused by the oscillation of the swash plate 107 and wafts as an oil mist in the crank chamber 176 to effectively lubricate the surface of the swash plate 107.

A part of the wafting oil is sucked together with the blow-by gas into the suction chamber through passage bores 138, 139 for the blow-by gas and effectively lubricates the sliding surfaces of the cylinder bore and the piston. Thereafter, most part of the lubrication oil is discharged to the refrigeration cycle together with the refrigerant, while the remainder is returned to the crank chamber 176 along with the blow-by gas.

Other part of the wafting oil is discharged through passage bores 154, 155 formed in the partition walls 172, 173 into the oil chamber 149 and is accumulated therein.

As the compressor is stopped, the oil attaching to the swash plate 107, thrust bearings and the wall of the crank chamber and the oil wafting in the crank chamber 176 drop or flow down to the bottom of the crank chamber 176. At the same time, the oil residing in the suction chambers 136, 137 flows into the crank chamber 176 through the passage bores 138, 139. Further, the oil in the oil separation chamber 164 flows through the roller bearings and the thrust bearings and finally is introduced into the crank chamber 176.

Therefore, the oil level in the crank chamber 176 is gradually raised and comes to exceed the level of the passage bores 154, 155 in the side walls 172, 173. Then, the oil is split from the crank chamber 176 through the passage bores 154, 155 and flows into the oil chamber 149 so as to be accumulated therein.

The oil accumulated in the oil chamber 149 makes a foaming when the compressor is started and flows into the crank chamber 176 through the passage bores 154, 155 to effectively lubricate the thrust bearings and the surfaces of the wash plate 107, and is then sucked into the suction chambers 136, 137 through the passage bores 138, 139.

Since the lower part of the swash plate 107 is dipped in the oil accumulated in the crank chamber 176, the areas on the surfaces of the swash plate 107 on which the shoes slide are effectively wetted by the lubrication oil as the swash plate 107 makes one revolution.

Further, the oil staying in the oil collecting chamber 156 is supplied to the thrust bearings 143, 144 through the oil feeding bore 147 from the inner sides of these thrust bearings.

As has been described, the second embodiment has an additional feature to keep the lower part of the swash plate 107 dipped in the lubrication oil to ensure a safe lubrication at the time of starting of the compressor.

Figure 7:
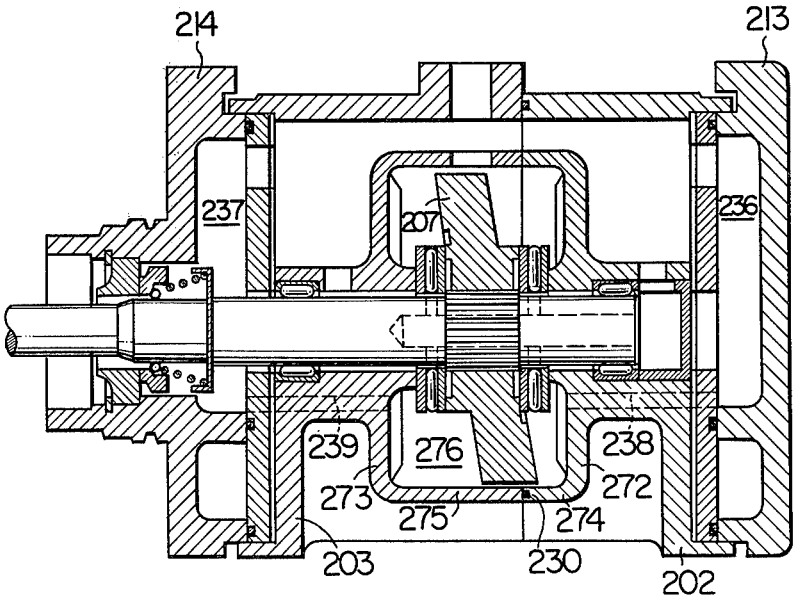
FIG. 7 is a sectional view similar to that of FIG. 1 of a third embodiment of the invention.

A third embodiment of the invention will be described hereinafter with specific reference to FIG. 7.

The compressor of this third embodiment has a pair of cylinder blocks 202, 203 the peripheral walls of which directly constitute the outer shell of the compressor.

Therefore, a sealing member 230 is disposed between the junction surfaces of the cylinder blocks 202, 203 to interrupt the communication of the space in the cylinder blocks with the ambient air.

Also, the side covers 213, 214 of this embodiment are jointed to the ends of the peripheral walls of the cylinder blocks 202, 203.

On the other hand, the space which constitutes the oil chamber in the first and second embodiments is eliminated, and the partition walls 272, 273, 274 and 275 defining the crank chamber 276 directly constitute the outer shell of the compressor. Other portions of the compressor of this embodiment than pointed out above are all identical to those of the second embodiment.

The lubricating action performed in this compressor is identical to that in the compressor of the second embodiment, except that there is no splashing of oil from the crank chamber 276 into the oil chamber. The elimination of splash of oil from the crank chamber 276 in turn increases correspondingly the density of the oil in the blow-by gas residing in the crank chamber 276.

As in the case of the second embodiment, the oil attaching to various parts of the crank chamber and the oil wafting in the same freely flows or drops down to the bottom of the crank chamber 276, as the compressor is stopped.

Also, similarly to the second embodiment, the oil in the suction chambers 236, 237 is made to flow into the crank chamber through the passage bores 238, 239.

However, since the compressor of this third embodiment does not have the oil chamber which is employed in the first and second embodiments and communicated with the crank chamber 276, the oil returned to the bottom of the crank chamber 276 is made to stay in the crank chamber 276. Therefore, at the time of starting of the compressor, the oil level is raised as a result of the foaming to lubricate the sliding parts. The swash plate 207 is effectively lubricated also by the oil in which the lower part of the swash plate 207 is dipped.

This third embodiment, therefore, offers an advantage that the swash plate 207 is lubricated effectively at the time of starting of the compressor.

Although the invention has been described through its peferred forms, needless to say, it is possible to impart various changes and modifications to the described embodiments, as stated below.

(1) In the first to third embodiments, the crank chamber 76, 176, or 276 can suitably be isolated from the sucked refrigerant passage.

(2) In the first to third embodiments, it is possible to substitute suitable means for feeding lubricating oil, for the described lubrication oil supplying system including the oil collecting chambers 56; 156; 256, oil feeding bores 47; 147; 247.

(3) In the first to the third embodiments, it is possible to provide for an arrangement such that the oil is supplied along with the refrigerant through the passage bore, provided in the peripheral wall of the crank chamber 76, 176, or 276, by way of which the crank chamber is communicated with the refrigerant passage.

As has been described, according to the invention, the blow-by gas residing in the crank chamber is sucked into the suction chambers through the passage by which the suction chambers are directly communicated with the crank chamber. In consequence, it becomes possible to maintain a sufficiently low pressure in the crank chamber, which in turn permits a smooth supply of the lubrication oil into the crank chamber, as well as the introduction of refrigerant into the crank chamber at a proper amount.

In addition, since the arrangement is made such that the oil raised by the foaming taking place in the crank chamber flows into the crank chamber without fail, a safe lubrication of the sliding parts in the crank chamber is assured at the time of starting of the compressor.

What is claimed is:

1. A swash plate type compressor for use in an air-conditioning system for vehicles, comprising a pair of cylinder blocks having a plurality of cylinder bores; a rotary shaft rotatably supported by said cylinder blocks; a swash plate fixed to said rotary shaft and disposed at a center of said cylinder blocks; pistons engageable with said swash plate and slidingly movable in said cylinder bores upon an oscillatory rotation of said swash plate; side covers attached to the ends of said cylinder blocks through respective valve plates; a suction chamber formed in each of said side covers; a refrigerant suction passage formed in a portion of said cylinder blocks between adjacent cylinder bores above the rotary shaft for communicating a suction inlet of the compressor with the suction chambers by way of first passage bores formed in said valve plates; a crank chamber disposed at the center of said cylinder blocks and defined by partition walls enclosing a space in which said swash plate oscillatorily rotates, an opening being formed in a peripheral portion of said partition walls opposite said suction inlet for communicating said crank chamber with said refrigerant suction passage; an oil chamber disposed below said rotary shaft and around said crank chamber and defined between said cylinder bores in said cylinder blocks, said oil chamber being substantially closed except that said oil chamber is in communication with said crank chamber through a second passage bore formed in a portion of said partition walls between said crank chamber and said oil chamber, and said oil chamber having substantially no direct communication with said suction chambers; and third passage bores formed in hubs of the respective cylinder blocks in parallel relationship with a shaft bore in said cylinder blocks accommodating said rotary shaft, each of said third passage bores having a first end opening directly into said crank chamber and a second end directly communicating with a bottom of an associated suction chamber through an associated valve plate whereby during operation of the compressor a refrigerant flow passage extends from said suction inlet to said suction chambers through said opening in said peripheral portion of said partition walls, said crank chamber and said third passage bores; during a halt in operation of the compressor lubricating oil accumulated in said suction chambers is returned to said oil chamber through said crank chamber by way of said third passage bores and said second passage bore; and during a start in operation of the compressor, when boiling of the lubrication oil in said oil chamber takes place due to foaming, oil is sprayed through said second passage bore from said oil chamber into said crank chamber so that said swash plate is lubricated.

2. A swash plate type compressor as set forth in claim 1, further comprising separating walls positioned within said refrigerant suction passage and respectively disposed between the partition walls and said valve plates, portions of said separating walls and said partition walls defining oil collecting spaces and second spaces being defined between said separating walls and said valve plates, a fourth bore formed through each of said separating walls at a location spaced radially from said rotary shaft, a suction inlet of the compressor being in communication with the respective suction chambers through said fourth bores, said second spaces and said first passage bores, and a fifth bore extending from the bottom of a first of the oil collecting spaces to said oil chamber through said cylinder blocks for communicating the oil collecting space with said chamber.

3. A swash plate type compressor as set forth in claim 2 further including an additional oil collecting space disposed between an end of the rotary shaft and one of the valve plates, a sixth bore communicating a second of the oil collecting spaces with said additional oil collecting space, and a seventh bore extending through said rotary shaft for communicating said additional oil collecting space with thrust bearings disposed at a center of said swash plate.

4. A swash plate type compressor as set forth in claim 3, wherein said second passage bore is formed through a bottom of a peripheral portion of said partition wall defining said crank chamber.

* * * * *